US005096217A

United States Patent [19]

Hunter

[11] Patent Number: 5,096,217

[45] Date of Patent: * Mar. 17, 1992

[54] MONOSKI WITH DEEP SIDE CUTS AND CAMBERED SEGMENT IN THE BINDING PORTION

[76] Inventor: Kent Hunter, 3017 E. 9400 South, Sandy, Utah 84092

[ * ] Notice: The portion of the term of this patent subsequent to Feb. 26, 2008 has been disclaimed.

[21] Appl. No.: 644,323

[22] Filed: Jan. 22, 1991

Related U.S. Application Data

[63] Continuation-in-part of Ser. No. 522,478, May 11, 1990, Pat. No. 4,995,631, which is a continuation of Ser. No. 278,560, Dec. 1, 1988, abandoned.

[51] Int. Cl.[5] ..... A63C 5/03

[52] U.S. Cl. ..... 280/607; 280/609; 280/14.2; D21/229

[58] Field of Search ..... 280/602, 610, 607, 600, 280/601, 609, 14.1, 14.2; 441/68, 71, 74; D12/8; D21/229

[56] References Cited

U.S. PATENT DOCUMENTS

| | | | |
|---|---|---|---|
| 3,326,564 | 6/1967 | Heuvel | 280/602 |
| 3,398,968 | 8/1968 | Mutzhas | 280/602 |
| 4,221,400 | 9/1980 | Powers | 280/602 |
| 4,300,786 | 11/1981 | Alley | 280/602 |
| 4,696,487 | 9/1987 | Girard | 280/602 |
| 4,953,884 | 9/1990 | Diard et al. | 280/610 X |
| 4,995,631 | 2/1991 | Hunter | 280/607 |

FOREIGN PATENT DOCUMENTS

| | | | |
|---|---|---|---|
| 0182776 | 5/1986 | European Pat. Off. | 280/602 |
| 3418604 | 11/1984 | Fed. Rep. of Germany | 280/602 |
| 3620078 | 12/1987 | Fed. Rep. of Germany | 280/602 |
| 8603982 | 7/1986 | World Int. Prop. O. | 280/602 |

*Primary Examiner*—Andres Kashnikow
*Assistant Examiner*—Brian L. Johnson
*Attorney, Agent, or Firm*—Terry M. Crellin

[57] ABSTRACT

A mono-ski for alpine skiing to which both of the skier's boot bindings are mounted such that the skier's boots are side-by-side, close together and both facing forward. The widest part of the forward or shovel area of the mono-ski is 30 percent or more wider than the narrowest part of the central or waist area of the mono-ski. The mono-ski has concave side cuts which are ¾ of an inch or more. The forward or shovel area of the mono-ski slopes gradually upward over at least the forward 15 percent and the rear or tail area slopes gradually upward over at least the rear seven percent of the total length of the mono-ski. The skier's boots are positioned rearward of the center, the thickness of the mono-ski is greatest at the central or waist area, the bottom is flat transversely without grooves and the mono-ski has camber. The bottom running surface should be of polyethylene or similar material. It is desirable that the top surface also be of the same material, to have bottom metal edges, interior reinforcing plates under the boot bindings and a protective metal insert in the tail of the mono-ski. The mono-ski can be made by methods and of materials commonly used in the industry.

8 Claims, 1 Drawing Sheet

MONOSKI WITH DEEP SIDE CUTS AND CAMBERED SEGMENT IN THE BINDING PORTION

BACKGROUND OF THE INVENTION

This application is a continuation-in-part of application Ser. No. 07/522,478, filed 5/11/90 now U.S. Pat. No. 4,995,631, which in turn was a continuation of application Ser. No. 07/278,560, filed 12/1/88 and now abandoned.

Skiing first evolved as a means of moving about efficiently in the deep snow of the Scandinavian countries. Two skis (dual skis) were necessary as the skis were used to allow a walking motion in snow. After the turn of the century the idea of sliding downhill and being mechanically pulled up again as a recreational sport occurred to many people. For well over 100 years people had been moving about on dual skis so it was only natural that dual skis would be used to slide downhill for recreation. The technology of dual ski performance soon became specialized for downhill (alpine) skiing. In the last 30 years, modern technology has been applied to the boots and bindings as well as the dual skis themselves to where today's boots, bindings and dual skis perform with magnificent ease compared to the equipment of even 20 years ago.

Inventors like Jacques Marchand, May 11, 1961, U.S. Pat. No. 3,154,312; Michael D. Doyle, Sept. 11, 1973, U. S. Pat. No. 3,758,127; and Alec Pedersen, Mar. 30, 1976, U. S. Pat. No. 3,947,049 realized the advantages of a monoski for alpine skiing and explained many of the advantages in each of their inventions. But dual skis were well established with dual ski technology improving every year. The inventors mentioned were all heading in the right direction but none of their monoskis were so far superior as to make a major impact on dual ski popularity. The subject invention monoski has the level of superiority over not only dual but all existing art monoskis to finally bring to the skiing public the greatly increased thrill and exhilaration of skiing that a properly designed monoski makes possible.

To properly cover the subject, snowboards should me mentioned. Firstly, the monoski of Robert C. Weber, Aug. 19, 1975, U.S. Pat. No. 3,900,204, is today considered a snowboard. As in the invention of Robert C. Weber, above, Wayne E. Stoveken, Jan. 1, 1974, U.S. Pat. No. 3,782,745; Marcel and Urs Muller, Dec. 15, 1981, U.S. Pat. No. 4,305,603; and Kuniski Kawahard, Sept. 20, 1983, U.S. Pat. No. 4,405,139, snowboards are utilized with the skier standing sideways on the board and using a technique similar to surfing and skateboarding. This is a great advantage as children can inexpensively learn the technique on skateboards and then later easily adapt to the far more expansive and exhilarating but more costly sport of snowboarding. Snowboarding is an entirely different type of alpine skiing than monoskiing and will soon attract its own substantial share of the alpine skiing market.

There are professionals and leaders in the industry who believe it is only a matter of time before most alpine skiing will be done on monoskis and snowboards.

The object of this invention was to create a ski which would make it possible for all skiers, regardless of age or skill level, to quickly or immediately enjoy the thrill and exhilaration of alpine skiing that comes when the skier is able to easily execute smooth effortless controlled turns as tight as the skier desires on any slopes and regardless of how difficult the snow conditions. The subject invention monoski has the capabilities necessary to accomplish this end.

Turning a dual ski properly requires five coordinated movements, strong rotational body force transferred through the legs to the ski, putting the ski on edge, transferring weight from the downhill to the uphill ski, keeping the two skis parallel and close together and unweighting the tail of the ski. All five motions must be perfectly coordinated if tight controlled turns are to be accomplished in any snow conditions. It is so difficult to perfectly coordinate all five of these motions that few skiers ever reach the expert level and therefore never fully enjoy alpine skiing.

The subject invention monoski totally eliminates the necessity for unweighting, and as does any monoski, eliminates the necessity of shifting weight from one ski to the other and the necessity of keeping both skis parallel and close together. The subject invention monoski, therefore, eliminates the necessity for three of the five motions needed to properly turn dual skis. Only the two remaining motions need be used to properly turn the subject invention monoski and on groomed slopes only one of the two motions need be used by a beginning skier. This motion is the setting of the edge of the monoski. This means that the beginning skier can comfortably come down a groomed slope having to concentrate on only one motion, rocking the subject invention monoski from one edge to the other. This can easily be mastered in a matter of hours. Next the beginning skier can concentrate on the only other motion needed, keeping the body always facing downhill. The rotational forces automatically generated by keeping the body always facing downhill are sufficient, combined with setting the monoski's edges, to enable the skier to execute smooth effortless controlled turns as tight as the skier desires on any slope regardless of how difficult the snow conditions.

In summary, the subject invention monoski is considerably easier to ski than dual skis or existing art monoskis. Any dual-ski skier or existing art monoskier, regardless of their skill level, can switch over to the subject invention monoski and immediately ski better than they did before and any beginning skier will become a better skier much sooner.

Many skiers think it will be difficult to switch over to a monoski as all the skier's weight should be on the uphill boot, not the downhill boot as is required when skiing dual skis. It is unnatural to put weight on the downhill boot so this must be learned by a great deal of practice when skiing dual skis. It is completely natural to put weight on the uphill boot so this does not need to be learned when skiing a monoski. Interestingly, even expert skiers who have trained their body to put their weight on the downhill ski will automatically correctly put their weight on the uphill boot on the very first turn when switching over to a monoski. The beginning skier will also automatically and without thinking, correctly put their weight on the uphill boot including shifting their weight to the uphill boot during a turn.

Balance when standing still is not a problem for even the beginner as the unusually wide forward section of the subject invention monoski gives ample sideways platform balance support. Ski pole use is exactly the same for the monoski as for dual skis.

It is important to note that alpine skiing is a sport which few people beyond 40 and hardly any beyond 60 engage in and enjoy. It is the difficulty and effort required to ski dual and existing art monoskis at an enjoyable and safe skill level that prevents most middle aged and senior skiers from staying with the sport or taking up the sport. The subject invention monoski will open up to this group and to all skiers and would be skiers the thrill and exhilaration of alpine skiing that comes when the skier is able to easily execute smooth effortless controlled turns as tight as the skier desires on any slope and regardless of how difficult the snow conditions.

SUMMARY OF THE INVENTION

The present invention is a monoski for alpine skiing where the skier's boots are side-by-side, close together and facing forward and which has an entirely new overall special shape and contour. Different lengths may be made, but the relationship of certain dimensions to each other must remain the same as the preferred embodiment.

The monoski has an unusually wide forward or shovel area which is at least 30 percent or more wider than the narrowest part of the central or waist area. This creates the unusually severe side cut which allows the monoski to be easily turned and without unweighting. It also allows the monoski to float easily above or below the surface in light powder snow and to float easily on top of melting snow. Further, it allows the monoski to float through deep tracked "crud" conditions and ride over tracked melting snow which has refrozen without being directionally destabilized. Still further, it provides sideways platform stability when the skier is not moving.

The rear or tail area of the monoski is considerably narrower than the forward or shovel area. This combined with the boots being mounted towards the rear or tail area results in the rear or tail area supporting at least twice the weight per square inch as the forward or shovel area. This gives the monoski the capability of running straight when the skier wants to go straight, something hard to do on existing art monoskis.

The forward and rear areas of the monoski slope gently upward allowing depth control in deep powder, lowering tail resistance in skidding turns and shortening the forward and rear snow contact points which furthers the capability of the monoski to turn easily and without weighting.

It is recommended that the monoski be of stiffer than normal construction and have greater than normal camber. This increases the bite into the snow of the severe concave side cut when the monoski is put on edge increasing the monoski's turning force. It also puts more weight on the rear area relative to the forward area, increasing the monoski's capability to run straight when the skier wants to go straight.

It is further recommended that a foam core be used, aluminum plates be laminated in the monoski to securely hold boot binding screws, the bottom be flat transversely without grooves and a protective metal insert be laminated into the tail of the monoski. The same non-stick material, such as polyethylene, should be used on the top surface as on the bottom to prevent snow buildup on the monoski.

The monoski can be made by methods and of materials as are commonly used in the ski industry.

IN THE DRAWINGS

Referring now to the drawings.

The subject invention is most like a monoski and is therefore called a monoski through the specification. The subject invention monoski is for alpine skiing and has both of the skier's boot bindings mounted so that the skier's boots are side by side, close together and both facing forward. The subject invention monoski has an entirely new overall special shape and contour.

Figure 1:
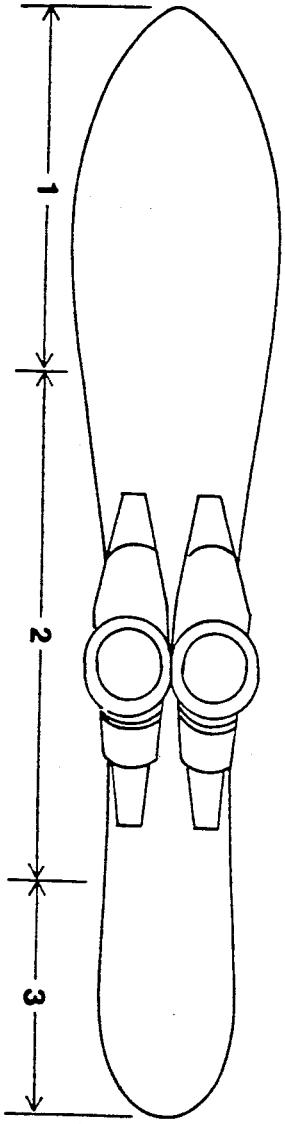
FIG. 1 is a top plan view of the preferred embodiment of the monoski and mounted boots.
Figure 2:
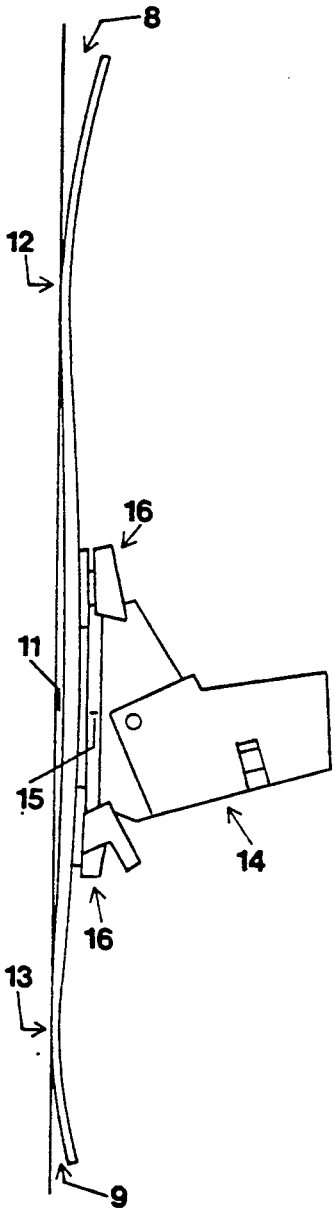
FIG. 2 is a side elevation view of the preferred embodiment of the monoski and mounted boots.
Figure 3:
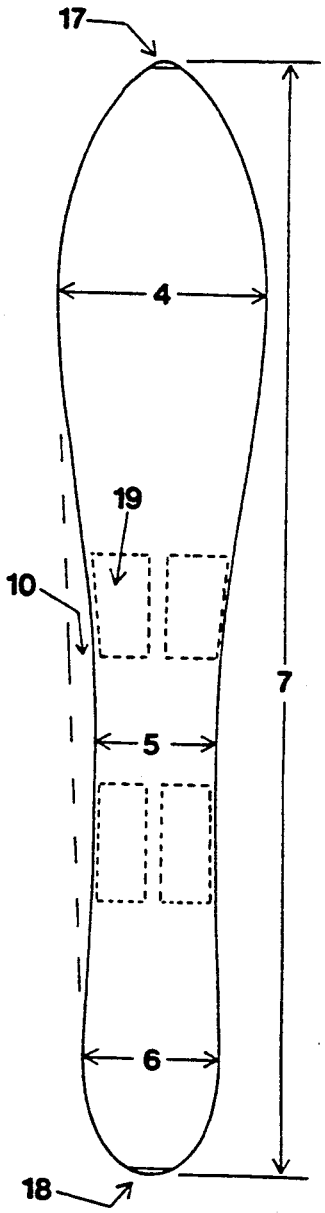
FIG. 3 is a top plan view of the preferred embodiment monoski.

Referring to FIGS. 1-3, in the preferred embodiment of the subject invention monoski, the forward or shovel area 1 is 12¼ inches wide as shown by arrow 4, the central or waist area 2 is 7⅛ inches wide as shown by arrow 5, the rear or tail area 3 is 8 inches wide as shown by arrow 6, the straight line length is 64¾ inches as shown by arrow 7, the side cut 10 is 1⅜ inches and the camber 11 is ½ inch. Of the extensive prototypes tested, it is this embodiment that is preferred. Different lengths may be made, but the relationship of certain dimensions to each other must remain the same as those of the preferred embodiment if the performance characteristics of the preferred embodiment are to be maintained.

For a longer or shorter subject invention monoski, the proper relationship between these certain dimensions will be maintained by using the following formula. The decimal relationship of the new desired length is first established by dividing the straight line length of the new desired length monoski by the straight line length of the preferred embodiment 7. This decimal relationship is then multiplied times the widest forward 4, narrowest central 5 and widest rear areas 6 of the preferred embodiment. Said obtained "decimal relationship determined dimensions" are held and modified as follows.

The width of the narrowest or central area of the new desired length monoski is dependent upon the width of the two ski boots that will be mounted side by side towards the rear of the central area. If the new desired length is being made for young children, then the width can be as little as 6 inches. If the new desired length is expected to be used by male adults, the width should be as much as 7⅛ inches.

Next, the narrowest central area "decimal relationship determined dimension" width of the new desired length monoski is subtracted from the narrowest central area width of the new desired length monoski as is determined by the expected width of the two side-by-side ski boots. If the result is a minus FIGURE, then this amount is subtracted from the "decimal relationship determined dimensions" for the widest forward area and the widest rear area of the new desired length monoski. If the result is a plus figure, then this amount is added to the "decimal relationship determined dimensions" for the widest forward area and the widest rear area of the new desired length monoski. The camber of the new desired length monoski is determined by multiplying the decimal relationship times the camber of the preferred embodiment 11. The distance from the tip to the midsole mark on the mounted boot of the new desired length monoski is also determined by multiplying the decimal relationship times the distance from the tip 17 to the midsole mark on the mounted boot 15 of the preferred embodiment.

The unusually severe concave side cut 10 of the subject invention monoski is critical in the capability of the monoski to be turned by the skier with extreme ease and with no unweighting. The unusually severe concave side cut 10 is a result of the unusually wide forward or shovel area 1 and narrow as possible central or waist area 2. As noted in FIG. 3, the side cut 10 is the maximum distance from the side of the monoski at the central or waist area 2 out to a point which intersects a straight line drawn from the widest part of the forward or shovel area 1 of the monoski to the widest part of the rear or tail area 3 of the monoski.

Modern skiing techniques require that the ski be tilted back and forth, from one edge to the other, in making continuous linked turns. The further out the edges of the widest forward and rear areas of the ski are from the center line of the boots, the more effort is required to tilt the ski on edge. The edges are out considerably further on the preferred embodiment of the subject invention monoski than any existing art monoski or dual ski, however it is still not tiring or difficult to tilt the subject invention monoski continuously back and forth from one edge to the other. The reason is that modern plastic ski boots immobilize the ankle and then reach at least to the calf making the entire length of the leg a long and powerful lever arm rigidly attached to the ski. However, even with modern ski boots, edges further out than the preferred embodiment will become tiring to continuously tilt on edge.

The importance of eliminating unweighting when making turns is noted throughout the specification as one of the desirable objects of this invention. It is principally the unusually severe concave side cut 10 that makes this possible. The advantage of totally eliminating the necessity of unweighting when making a turn, even in the most resistive snow conditions such as sticky wet snow or windblown crust, is that the skier is freed from a considerable amount of physical effort. Most skiers will experience a less difficult and more fluid motion. All skiers will be physically able to make more turns and ski more terrain in a given period.

The necessity for unweighting when skiing existing art skis needs to be explained as even in the industry not everyone understands the mechanics of turning a ski. Briefly, skiing conventional design dual or monoskis, the skier must apply sufficient rotational force with his body to skid the tail of the ski sideways through a turn. Contrary to popular belief, conventional skis do not totally carve their turn in anything less than a giant slalom turn. Most of the time conventional design dual or monoskis are too long or snow conditions too resistive to allow skidding the tail of the ski sideways through the desired turn without unweighting the tail of the ski. This means the skier must unweight the tail of the ski at the same instant he is applying rotational force to the ski. This unweighting sufficiently frees the tail area of the ski from the resistance of the snow so that it can respond to the rotational forces applied by the skier and skid sideways through the desired turn. The unweighting is accomplished by either a hopping motion or a fast sinking motion. As this must be done on every turn, it can be seen a great deal of energy is consumed.

The subject invention monoski can carve a tighter turn than any existing art dual or monoski; however when it rotates inside its own length or makes a very tight turn, even it can do so only with a considerable amount of sideways skidding. However, the subject invention's unusually severe concave side cut 10 and rounded 18 upward sloping 9 rear or tail area 3, which will be explained further on, make it possible to execute such turns without unweighting, saving, as noted, a great deal of energy.

The unusually wide forward or shovel area 1 of the monoski serves a number of purposes. First, it creates the unusually severe concave side cut 10. Secondly, the unusually wide forward or shovel area 1 of the monoski allows the monoski to float easily above or below the surface in light powder snow. When skiing melting snow, unless the ski can float on top, as does the subject invention monoski, such melting snow can make turning conventional dual or monoskis which sink in, extremely difficult. The unusually wide forward or shovel area 1 also makes it possible for the subject invention monoski to float through and turn in deep tracked "crud" conditions without being directionally destabilized. Using conventional dual or monoskis, skiing in such "curd" is difficult for all but expert skiers. Melting snow which is skied and then refreezes overnight, has ruts, tracks and clumps of frozen snow which catch and misdirect narrow skis. Again, the unusually wide forward or shovel area 1 of the subject invention monoski is wide enough so that it is not directionally destabilized by these conditions and therefore can be easily turned in these conditions and without unweighting. A further advantage of the unusually wide forward or shovel area is that it provides sideways platform stability when the skier is not moving. The skier always has ski poles but it is safer and a more comfortable feeling for most skiers if they can easily balance themselves when not moving without having to use their ski poles.

The central or waist area 2 of the monoski is where the boots 14 are mounted. The boots 14 are positioned side by side, close together and both facing forward. In the preferred embodiment, the midsole mark 15 on the mounted ski boot 14 should be 39¼ inches back on a straight line from the forward tip of the monoski 17. This is 60.6 percent of the straight line length of the monoski back from the forward tip 17.

The rear or tail area of the monoski 3 is considerably narrower than the forward or shovel area 1. As is explained further on, this helps to keep the monoski running straight when the skier wants to go straight. Typically, existing art monoskis turn easily but are difficult to ski straight. The subject invention monoski is considerably easier to turn than any existing art monoski even without unweighting and yet is easier to keep straight than any existing are monoski. This is accomplished by the rear or tail area 3 being considerably narrower than the forward or shovel area 1 and in addition, the rear or tail area 3 supporting more of the weight of the skier. As noted, the preferred embodiment attaches the boots 14 towards the rear or tail area 3 of the monoski which results in the per square inch pressure on the snow being more than double in the rear or tail area 3 than the forward or shovel area 1. This directionally stabilizes the monoski when the skier wishes to go straight without reducing the unusual capability of the monoski to be turned with extreme ease and without unweighting. To understand this, one only has to think of a boat which is heavy in the bow. Such a boat is directionally very unstable whereas the same boat becomes directionally stable if more weight is in the stern than in the bow. While snow is not as fluid a medium as water, it is sufficiently fluid to where the principle still applies.

In the preferred embodiment, the forward or shovel area 1 of the monoski slopes upward on a gentle curve 8 over 14 inches until it has raised 2¼ inches above the flat snow surface. This gentle forward, upward curve 8 is important and differs from prior art monoskis where boots are positioned side-by-side, close together and facing forward. Such prior art has a pronounced upward curve near the forward tip of the ski. By having a gentle upward curve 8 the entire monoski can be kept below the surface of the snow when skiing deep light powder, a technique preferred by many expert deep powder skiers. If a skier inadvertently runs into a mogul, a sharply curved tip or shovel will usually be abruptly stopped by the mogul, throwing the skier forward. The monoski's gentle upward curve 8 will often cut through the mogul depending upon snow conditions and the mogul's size. The monoski's gentle upward curve 8 is sufficiently curved to prevent the monoski from diving into the snow, even with extreme forward pressure by the skier. Further, the long gentle upward curve 8 at the forward or shovel area 1 of the monoski and the relatively long gentle curve 9 at the rear or tail area 3 of the monoski, means a much shorter snow contact length than the overall length of the monoski. Convention dual and monoskis make snow contact 6 to 7 inches back from the tip and 1 to 1½ inches forward of the tail. In the preferred embodiment, the monoski makes snow contact 12 and 13, 14 inches back from the tip and 8 inches forward of the tail. The shorter the wheel base of any vehicle, the tighter turn it can make. In the same way a ski also can make shorter turns, the closer together the forward and rear snow contact points 12 and 13 become.

In the preferred embodiment, the rear or tail area 3 of the monoski slopes upward on a gentle curve 9 over 8 inches until it has raised 1¼ inches above the flat snow surface. The tail is also rounded 18. As has been explained, as with all skis in tight turns, the tail of the ski skids through the turn sideways. As the rear 8 inches 3 of the monoski is above the flat snow surface 9 when the tail skids sideways through the turn, resistance to such sideways skidding is greatly reduced. While not as important as the unusually severe concave side cut 10, this lowered resistance is still important in the capability of the monoski to be turned by the skier with extreme ease and without unweighting. The rounded tail 18 also offers less resistance to any snow which it might have to ski through sideways, this being particularly true when the monoski is totally below the snow surface as in the generally preferred technique for deep light powder skiing.

Increasing the stiffness and camber of conventional design skis generally decreases their ability to turn and increases their ability to track or ski straight. Therefore, dual skis made for high speed downhill racing are made as stiff and with as much camber as good overall design permits. Increasing the stiffness and camber of the subject invention monoski does not decrease its ability to turn with extreme ease and without unweighting but rather slightly increases this ability. The reason is that turning with extreme ease and without unweighting is largely made possible by the unusually severe concave side cut 10. When the subject invention monoski is put on edge by the skier, the stiffer the monoski and the more camber 10 it has, the more the forward part of the concave side cut arc digs into the snow transmitting an increasingly powerful turning force to the monoski itself. Increased stiffness and camber also increases the ability of the monoski to track or ski straight. As has been explained, this is a result of the per square inch pressure on the snow being more than double in the rear or tail area 3 than in the forward or shovel area 1. The stiffer the monoski and the more camber it has the more of the weight of the skier is placed on the rear area of the monoski which increases the rear area's bite into the snow and therefore improves tracking or skiing straight. The camber of the preferred embodiment is ½ inch 11. This is somewhat more than the camber generally found in conventional ski design.

The stiffness of the monoski is accomplished by doubling the top structural layer of the monoski which conventionally is a single layer of epoxy resin reinforced with woven glass cloth. The skier's weight places a compression force on the top of the monoski and a tension force on the bottom of the monoski, particularly as the camber is increased. Because compression structural members must be stronger than tension structural members to resist the same force, only the top structural layer needs to be doubled in stiffness is to be increased. This increased stiffness also increases the strength of the monoski. This is important to protect the structural integrity of the subject invention monoski. The wide forward or shovel area 1 of the monoski imparts more than the normal amount of stress found in conventional ski design on the narrowest part of the central or waist area 2, particularly when the skier impacts a mogul. Since the extreme ease of turning and without unweighting, tracking or skiing straight and serviceable life of the monoski are all improved by increased strength and resulting stiffness, this then is the recommended construction.

The monoski of the preferred embodiment of the present invention also may be manufactured to exhibit a predetermined torsional resistance during use. This torsional resistance, for purposes of simplicity in explanation, can be best defined as the ft-lbs of torquing force necessary to rotate the snow contact point (12) above the longitudinal axis of the monoski, through a circumferencial arch of three degrees relative to snow contact point (13). In other words, the torsional resistance is the torque in ft-lbs generated by twisting the monoski along its longitudinal axis through three degrees of rotation.

The torsional resistance of the monoski, along with its camber stiffness, are important to the design of the monoski of the present invention. The combined stiffness and torsion resistance afford the skier desired, predetermined response characteristics which substantially affect the skiers ability to control the path of the monoski through varied snow conditions and hill terrain.

In the preferred embodiment of the monoski, the torsional resistance as described above is preferably within the range of 10 to 30 ft-lbs. For example, a monoski of 150 cm length would preferably have a torsional resistance of approximately 15 ft-lbs. A monoski of 175 cm length would preferably have a torsional resistance of approximately 19 ft-lbs, and a monoski of 200 cm length would preferably have a torsional resistance of approximately 23 ft-lbs. As with the case of camber stiffness, longer or shorter monoskis would have an equivalently greater or lesser torsional resistance than stated in the examples.

It is recommended that the stiffness of the monoski be sufficient to prevent the camber (11) from flattening, i.e. to prevent the bottom surface of the monoski between the snow contact points (12 and 13) to become generally planar in configuration. This stiffness is best defined ad the minimum force (in pounds) applied to the monoski at the midsole mark (15) thereof which will cause the camber (11) of the monoski to flatten. In the preferred embodiment of the present invention, the stiffness is recommended to be at least equivalent to fifty pounds force, and more preferably with the range of 20 to 180 pounds force. For example, a monoski formed in accordance with the principles of the present invention of a length of 150 cm would preferably have a camber stiffness of at least 40 pounds, and more preferably, approximately 65 pounds. A monoski of 175 cm length would preferably have a camber stiffness of at least 50 pounds, and more preferably, approximately 85 pounds. A monoski of 200 cm length would preferably have a camber stiffness of at least 80 pounds, and more preferably, approximately 140 pounds. Longer and shorter monoskis of course could each be formed with a camber stiffness which generally accorded with an extrapolation of the above identified range and examples.

Expanding on the above construction, it should be noted that the subject invention monoski, like all conventional ski design for all types of skis, has the thickest part of the ski in the central or waist area 2 tapering out and becoming thinner towards the tip 17 and tail 18 of the monoski. This is normal design for structural beam members having to support load in the mid area, such as a ski. This variation in thickness is accomplished by a non-structural spacing material (called a core) in the center layer of the ski's typically laminated construction. This spacing material, which is thicker in the central or waist area, in present art, is often of a plastic foam material. Some manufacturers use a wood core feeling it improves the ski's flex patterns. The subject invention monoski is recommended to be of a very stiff construction, any improved flex patterns from a wood core would be unnoticeable. A foam core is recommended as it will not rot from the inevitable introduction of moisture through binding attachment screw holes and will therefore improve the serviceable life of the monoski.

Thin, high tensile strength aluminum or other lightweight material plates 19 should be laminated under the top epoxy resin double woven glass reinforced structural layer to securely hold the screws which attach the boot bindings 16 to the monoski. Manufacturers often use such plates but many such manufactures will choose not to use such plates because of cost and or not wanting to increase the stiffness of the ski and interfere with its flex patterns. Once again, as the subject invention monoski is recommended to be of a very stiff construction, such plates may be used without detrimentally affecting the performance of the monoski. Such plates to securely hold the binding's attachment screws are recommended, and again to increase the serviceable life of the monoski.

The bottom running surface of the subject invention monoski, in the preferred embodiment, should be flat transversely over the entire length of the monoski. A longitudinal groove or grooves will add no noticeable change in the performance characteristics of the monoski and is therefore not recommended. Such grooves add cost to production and the material used on the bottom running surface, being thinner in the groove, is more easily torn all the way through in the groove area from the almost unavoidable occasional rock. The bottom running surface should be of polyethylene or any similar non-stick material (known in the industry as P-Tex). The thickness of the P-Tex should be such that it is flush to or slightly above the metal bottom edges. Metal edges that protrude below the bottom running surface (called railing) detrimentally affect the performance of any ski. Thicker P-Tex that is slightly above the metal bottom edges will extend the serviceable life of the monoski, particularly if hand file sharpening of the edges is done as opposed to sanding down the entire bottom merely to sharpen the edges.

The top surface of the preferred embodiment of the subject invention monoski should be of the same P-Tex or similar material as the bottom running surface. The unusually wide forward or shovel area 1 of the monoski tends to mound up with collected snow. The snow will more easily slide off if the top surface of the monoski is P-Tex or a similar slippery material. Additional spraying of silicone will prevent even the stickiest snow from building up. Graphics are printed on the underside of the almost transparent P-Tex or similar material top surface as is common in the industry for the bottom P-Tex or similar material running surface.

The tail 18 of the monoski should have an aluminum or other lightweight material protective tip molded into the laminated layers of the monoski when it is fabricated. The monoski is relatively heavy and when set upright on its tail by the skier, as is often necessary, the normal construction material of epoxy resin reinforced by woven glass cloth will soon become damaged and unsightly. A similar protective tip can be molded into the forward tip of the monoski for a more finished appearance but is not as necessary as few skiers will set the monoski upright on its tip.

The bottom edges of the monoski should have protective metal edges. In the preferred embodiment, these edges should not be cracked but rather solid. Solid edges are stiffer, but as has been explained, added stiffness is a benefit for the subject invention monoski. Also, solid edges are stronger, extending the serviceable life of the monoski. The bottom metal edges in the preferred embodiment run the entire length of the monoski from the forward tip protective insert to the rear tail protective insert which gives the monoski a more finished appearance.

I claim:

1. A monoski having an elongate body to which a skier's boot bindings are intended to be mounted such that the skier's boots are symmetrically mounted along each side of said monoski in a longitudinal direction, comprising a shovel section separated from a tail section by a waist section, each of said sections being symmetrically oriented along a longitudinal axis which extends centrally along said elongate body, said shovel section, waist section and tail section forming a continuous bottom surface of said monoski, said shovel section having a widest portion, measured perpendicularly from said longitudinal axis, which is at least 30 percent wider than a narrowest portion of said waist section similarly measured perpendicularly from said longitudinal axis, said shovel section further having a front end portion which curves upwardly in a direction away from said bottom surface, said tail section also having a widest portion measured perpendicularly from said longitudinal axis, which is wider than said narrowest portion of said waist section, and at least 25% narrower than said widest portion of said shovel section, said tail section also having a back end portion which curves upwardly in a direction away from said bottom surface, said elongate body including a cambered segment between said widest portion of said shovel section and said widest portion of said tail section, said cambered segment causing a segment of said bottom surface corresponding thereto to be curved upward while in a non-stressed state, said cambered segment further being formed with a camber stiffness sufficient to prevent forces of less than 20 pounds applied to said elongate body from flattening said segment of said bottom surface corresponding to said cambered segment, whereby when said monoski is placed on any relatively flat sloping surface, including as a hill covered with snow, the stiffness of said monoski will cause contact forces between the flat sloping surface of said bottom surface of said monoski to be concentrated at said widest portion of said shovel section and said widest portion of said tail section, and away from said waist section, said front portion of said shovel section and said back portion of said tail section, and whereby, a downward force applied to said tail section, due to a smaller size compared to said shovel section, causes greater pressure on the flat sloping surface than a similar force applied to said shovel section.

2. A monoski according to claim 1 wherein said elongate body is formed with a torsional resistance, measured as the torquing force required to rotate said widest portion of said shovel section about said longitudinal axis a distance of three degrees, of approximately 10 to 30 ft-lbs.

3. A monoski according to claim 1 wherein said waist section has a thickness greater than said shovel section and said tail section.

4. A monoski according to claim 1 wherein said widest portion of said shovel section is spaced away from, so as to be excluded from, said front end portion.

5. A monoski according to claim 1 wherein said widest portion of said tail section is spaced away from, so as to be excluded from, said back end portion.

6. A monoski according to claim 1 wherein said camber stiffness is in the range of 50–150 pounds force.

7. A monoski according to claim 2 wherein said torsional resistance is within the range of 15 to 25 ft-lbs.

8. A monoski according to claim 1 having side cuts which measure at least ¾ of an inch, said side cut measurements being defined as the minimum distance from the narrowest portion of said waist section to a point which intersects a straight line drawn from said widest portion of said shovel section to said widest portion of said tail section.

* * * * *